US005160307A

United States Patent [19]

Bacques et al.

[11] Patent Number: 5,160,307

[45] Date of Patent: Nov. 3, 1992

[54] MACHINE FOR MAKING A TAPERING CARTON

[75] Inventors: Jean-Yves Bacques, Paris; Guy Coalier, Noce, both of France

[73] Assignee: Otor, Paris, France

[21] Appl. No.: 808,773

[22] Filed: Dec. 17, 1991

[51] Int. Cl.[5] ..... B31B 3/28; B31B 25/28

[52] U.S. Cl. ..... 493/176; 493/295; 493/296

[58] Field of Search ..... 493/143, 153, 175, 176, 493/295, 296

[56] References Cited

U.S. PATENT DOCUMENTS

| | | | |
|---|---|---|---|
| 2,001,177 | 5/1935 | Bodor | 493/296 |
| 2,572,610 | 10/1951 | Gilbert | 229/31 |
| 2,643,815 | 6/1953 | Komeo | 229/44 |
| 4,242,949 | 1/1981 | Auckenthaler | 493/295 |
| 4,308,023 | 12/1981 | Bidegain | 493/295 |
| 4,932,930 | 6/1990 | Coalier et al. | 493/128 |

FOREIGN PATENT DOCUMENTS

| | | |
|---|---|---|
| 0334707 | 9/1989 | European Pat. Off. . |
| 3541821 | 6/1987 | Fed. Rep. of Germany . |
| 1216303 | 4/1960 | France . |
| 2629012 | 9/1989 | France . |
| 820050 | 9/1959 | United Kingdom . |

*Primary Examiner*—William E. Terrell
*Attorney, Agent, or Firm*—Fisher, Christen & Sabol

[57] ABSTRACT

A pack made of sheet material such as card or corrugated card has rectangular side faces that are interconnected in pairs by respective fold lines, said fold lines being mutually parallel and said side faces forming a rectangular parallelepiped. According to the invention this pack is remarkable in that it includes other side faces that form a pyramid whose base coincides with a face of said parallelepiped. The pack is obtained from a blank of sheet material that includes trapezium-shaped or triangular panels hinged to rectangular panels.

4 Claims, 7 Drawing Sheets

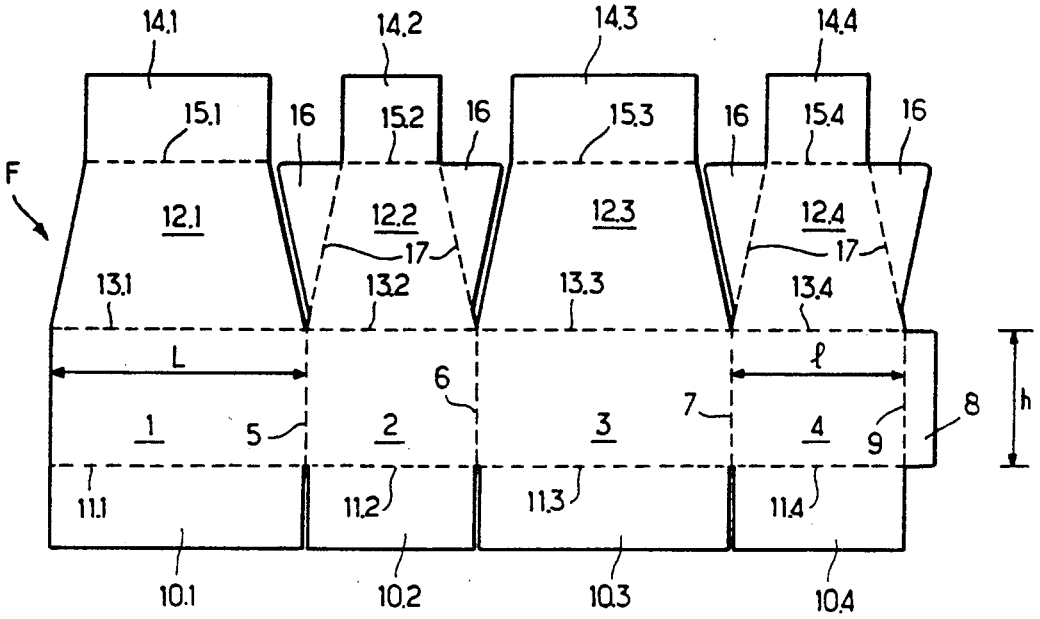
FIG. 1
FIG. 2
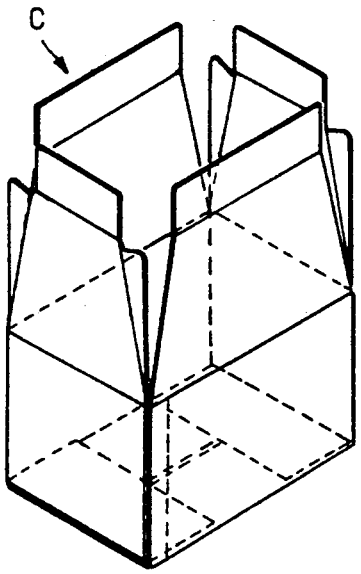
FIG. 3
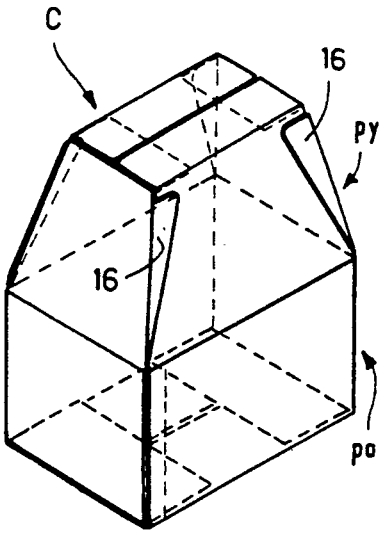

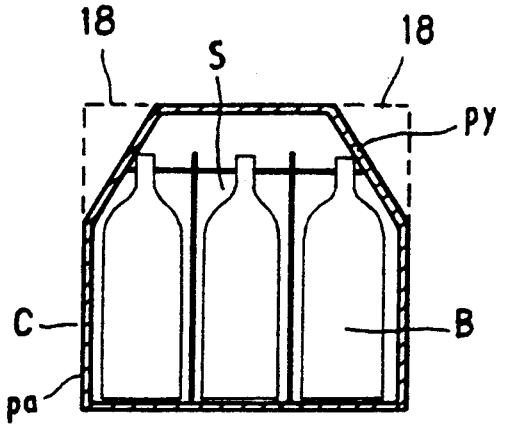
FIG. 4
FIG. 5
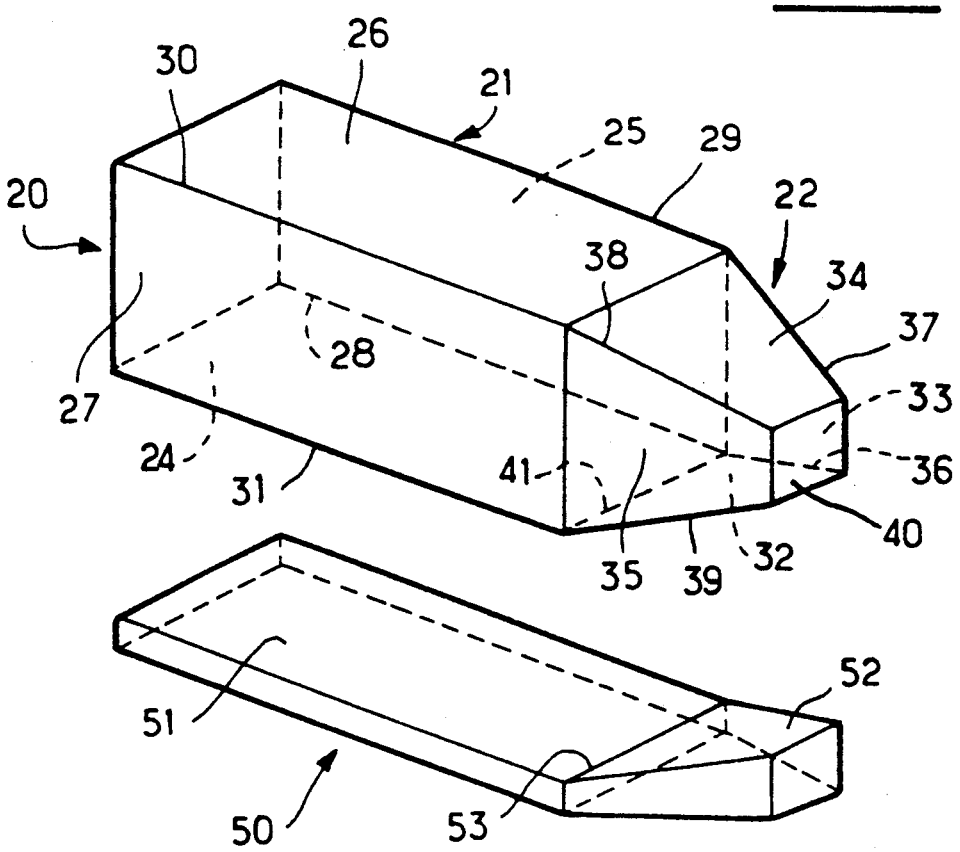

MACHINE FOR MAKING A TAPERING CARTON

The present invention relates to packs made of card, of corrugated card, or of analogous sheet material, and also to blanks of such material for making said packs, and to a machine for making said packs from said blanks.

BACKGROUND OF THE INVENTION

Patents U.S. Pat. No. 4,242,949, DE-A-3 541 821, and FR-A-2 629 012, for example, describe machines for making a pack out of card or the like by wrapping a blank around a mandrel. In those machines, the said mandrel is essentially in the form of a rectangular parallelepiped such that the packs obtained are likewise in the form of rectangular parallelepipeds.

Such packs are used for packaging objects or groups of objects that are inserted therein via a cover that is left open, with said cover being closed only after said objects have been inserted therein.

It happens rarely, and indeed almost never, that the section of the load constituted by said objects or groups of objects is constant up the entire height of the load, thereby fitting as closely as possible to the shape of the pack up the entire height of said pack into which said load is inserted, so at least some of the projecting corners of said pack are empty. As a result these empty projecting corners of the pack which are exposed to external attack are easily torn, which spoils appearance and reduces the protection afforded to the packaged goods. In addition, since they are useless, the empty corners of the pack constitute a waste of sheet material.

SUMMARY OF THE INVENTION

An object of the present invention is to remedy these drawbacks. To this end, the present invention provides a pack made of sheet material such as card or corrugated card, the pack comprising square or rectangular side faces interconnected in pairs by respective fold lines, said fold lines being parallel to one another and said side faces forming a rectangular parallelepiped, the pack being characterized in that it includes other side faces forming a pyramid connected by its base to said parallelepiped, and in that each of said other faces is constituted by a panel having free sloping side edges.

Thus, because of the parallelepiped-pyramid shape of the pack of the present invention:

the shape of the pack can be better adapted to the shape of the load it is to contain; and unused projecting empty corners of the pack are eliminated, thereby reducing the risks of such projecting corners being damaged and also making savings in sheet material.

It may observed that the patent U.S. Pat. No. 2,643,815 relates to a box for containing a substance in bulk, the box including trapezium-shaped panels that are connected to one another by triangular gussets for providing sealing between the trapezium-shaped panels when the bulk substance is poured out from the box using the spout constituted by the pyramid-shaped portion of the box.

The object of the patent U.S. Pat. No. 2,643,815 is thus not, as in the case of the present invention, to adapt to the shape of the objects contained, and on the contrary it is to act as a spout.

In any event, the sealing gussets integrally formed with the panels require special folding when the box is being formed and this is incompatible with industrial techniques of pack production.

The pack of the invention preferably includes lateral tabs providing sealing along the lateral ridges of said pyramid.

Said other lateral faces may be triangular. However, they are advantageously trapezium-shaped. Thus, said pack may be provided with a closure face that truncates said pyramid at its end which is furthest from said parallelepiped.

According to another aspect of the invention, a blank of sheet material such as card or corrugated card for making a pack of the present invention comprises a sequence of square or rectangular first panels connected to one another via mutually parallel first fold lines, and a first set of end flaps disposed along one of the sides of said sequence of panels and connected thereto by second fold lines perpendicular to said first fold lines and intended to constitute at least a portion of the bottom of said pack, the blank being remarkable in that it includes trapezium-shaped or triangular second panels each connected via its base to the side of a corresponding one of said first panels that is furthest from the end flaps of said first set, along a third fold line which is perpendicular to said first fold lines.

Advantageously, in order to obtain sealing along the lateral ridges of said pyramid, at least some of said second panels include a foldable trianglular tab along at least one of their free sloping edges, each tab being connected to the corresponding second panel via a fold line.

Preferably, with said second panels being trapezium-shaped, the blank includes a second set of end flaps disposed adjacent to the small basses of said second panels and connected thereto by fourth fold lines perpendicular to said first fold lines and intended to form at least a portion of a closure face for said pack.

French patent FR-A-2 629 012 describes a machine for making a pack from a blank of sheet material comprising a sequence of square or rectangular first panels connected to one another via mutually parallel first fold lines and a first set of end flaps disposed on one side of said sequence of panels and connected thereto via second fold lines perpendicular to said first fold lines and intended to form at least a portion of the bottom of said pack, said machine including:

a mandrel whose outside section corresponds to the inside section of said pack to be obtained;

means for freely supporting an intermediate panel of said sequence of panels at least approximately facing the corresponding face of said mandrel, but at a distance therefrom, and then for moving said intermediate panel towards said corresponding face of the mandrel, and then pressing said intermediate panel against said corresponding face after folding the panels adjacent to said intermediate panel so that said adjacent panels bear against said mandrel;

means for winding said sequence of first panels around said mandrel; and means for fixing together the end panels of said sequence of first panels when wound around said mandrel in this manner.

Such a machine makes it possible to remedy the drawbacks inherent to the machines provided for making "American" packs. It is therefore advantageous to improve such a machine for making packs of the invention.

To this end, according to another aspect of the present invention, the machine of the type recalled above is remarkable in that said blank includes trapezium-shaped or triangular second panels each of which is connected via its base to the side of a corresponding one of said first panels that is furthest from the end flaps of said first set, along a third fold line perpendicular to said first fold lines. with the sloping lateral edges of said second panels being free:

said mandrel being in the form of a rectangular parallelepiped having the base of a pyramid placed thereagainst;

said means for supporting, for moving, and for pressing said intermediate panel including a pressure plate having two rigidly interconnected faces, a first one of said faces corresponding to said intermediate panel and a second one of said faces corresponding to that one of said second panels which is adjacent to said intermediate panel, said first and second faces of the pressure plate defining a diherdral angle such that when said first face is pressed against the corresponding face of the rectangular portion of the mandrel, said second face is pressed against one of the faces of the pyramid-shaped portion of said mandrel that corresponds to said adjacent second panel, the edge of said dihedral angle then coinciding with the ridge of said mandrel between said faces of said mandrel that correspond respectively to said rectangular portion and to said pyramid-shaped portion;

means are provided for pressing said second panels against respective corresponding faces of the pyramid-shaped portion of said mandrel; and means are provided for fixing together said second panels when pressed in this way against said mandrel.

Thus, a first panel and a second panel of said blank are accurately positioned relative to the mandrel and are held relative to the corresponding faces thereof while said blank is being wound, such that the resulting pack is particularly accurate in shape.

When at least some of said second panels include along at least one of their sloping edges a foldable triangular tab connected to said corresponding second panel by a fold line, it is advantageous for said means for fixing said second panels together to include means for folding said triangular tabs and for fixing them to the second panels carrying them.

In addition, for a blank in which said second panels are trapezium-shaped and which includes a second set of end flaps disposed adjacent to the small bases of said second panels and connected thereto by fourth fold lines perpendicular to said first fold lines, for the purpose of forming at least a portion of a closure face for said pack, the machine of the invention includes:

means for folding the flaps of said second set against the end face of the pyramid-shaped portion of said mandrel; and means for fixing together said flaps folded down in this way.

Advantageously, said means for winding said sequence of first panels around the mandrel comprise moving equipment including rocking arms.

BRIEF DESCRIPTION OF THE DRAWINGS

An embodiment of the invention is described by way of example with reference to the accompanying drawings, in which:

FIG. 1 shows a flat blank of sheet material for making an embodiment of a pack in accordance with the present invention.

FIGS. 2 and 3 are perspective views of the pack obtained from the blank of FIG. 1, said pack being shown respectively open (FIG. 2) and closed (FIG. 3).

FIG. 4 is a vertical section showing one way in which the pack of FIGS. 2 and 3 can be used.

FIG. 5 is a perspective view of a mandrel and a pressure plate for making the pack of the invention.

DETAILED DESCRIPTION

Figure 6A:
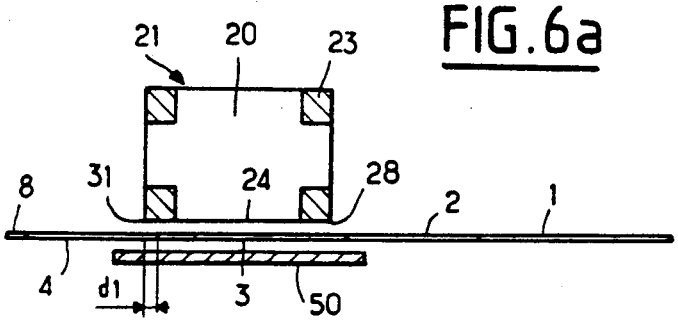
FIGS. 6*a*, 6*b*, 6*c*, and 7*a*, 7*b*, 7*c* are diagrams showing the process of making the pack of the invention from the blank of FIG. 1, with FIGS. 6*a*, 6*b*, and 6*c* being cross-sections through the rectangular portion of the mandrel and FIGS. 7*a*, 7*b*, and 7*c* being longitudinal sections of the mandrel.

The blank F of sheet material (e.g. card or corrugated card) shown in FIG. 1 comprises a sequence of four rectangular panels 1 to 4 in alignment and connected together in pairs via parallel preformed fold lines 5 to 7. A tongue 8 is disposed along the free edge of end panel 4 of said sequence of panels and is connected to said end panel 4 by a fold line 9 which is parallel to the fold lines 5 to 7.

One side of each of the panels 1, 2, 3, and 4 is provided with a respective rectangular flap 10.1, 10.2, 10.3, and 10.4. Each rectangular flap 10.1, 10.2, 10.3, and 10.4 is hinged to the corresponding panel by a preformed fold line 11.1, 11.2, 11.3, or 11.4. These fold lines 11.1, 11.2, 11.3, and 11.4 are in alignment and perpendicular to the fold lines 5 to 7 and 9. The sides of the panels 1 to 4 opposite to their sides associated with the flaps 10.1 to 10.4 are associated with respective trapezium-shaped panels 12.1, 12.2, 12.3, and 12.4. Each panel 12.1, 12.2, 12.3, and 12.4 is hinged to the corresponding panel via a preformed fold line 13.1, 13.2, 13.3, or 13.4 corresponding to the large base thereof. The fold lines 13.1, 13.2, 13.3, and 13.4 are in alignment and perpendicular to the fold lines 5 to 7 and 9.

The rectangular panels 1 to 4 and the tongue 8 are all of the same height h. The two panels 1 and 3 are identical to each other and are of length L. The two panels 2 and 4 are identical to each other, and are of length 1, which is less than L.

The sides of the trapezium-shaped panels 12.1 to 12.4 furthest form their sides associated with the panels 1 to 4 are associated with respective rectangular flaps 14.1, 14.2, 14.3, and 14.4. Each of the flaps 14.1 to 14.4 is hinged to the corresponding panel 12.1 to 12.4 by a preformed fold line 15.1, 15.2, 15.3, or 15.4 corresponding to the small base of said panels 12.1 to 12.4.

The fold lines 15.1 to 15.4 are in alignment and are perpendicular to the fold lines 5 to 7 and 9.

Finally, respective triangular tongues 16 are hinged along the two sloping edges of each of the panels 12.2 and 12.4 via preformed fold lines 17. The triangular tongues 16 of the panel 12.2 extend between said panel and the panels 12.1 and 12.3, while one of the triangular tongues 16 of the panel 12.4 extends between said panel and the panel 12.3. The other triangular tongue 16 of the panel 12.4 projects outwards on the same side as the tongue 8.

The blank F is designed to form the pack C shown in FIG. 3 by winding up and fixing together the panels 1 to 4, and by fixing together the panels 12.1 to 12.4 and the flaps 10.1, 10.2, 10.3, 10.4, 14.1, 14.2, 14.3, and 14.4 in the manner described below in greater detail with reference to FIGS. 6 to 16. The pack C has the general appearance of a parallelepiped pa surmounted by a pyramid py. The large side faces of the parallelepiped pa of the pack C are formed by the panels 1 and 3, while the small side faces thereof are formed by the panels 2 and 4, with the panels 12.1, 12.3 and 12.3 and 12.4 respectively forming the large faces and the small faces of the pyramid py. In addition, the bottom of the pack C is constituted by the flaps 10.1, 10.2, 10.3, and 10.4, whereas the cover of said pack C is constituted by the flaps 14.1, 14.2, 14.3, and 14.4. The tongues 16 are folded over the large faces of the pyramid py and they are fixed thereto, preferably by gluing, so as to provide sealing along the lateral ridges of said pyramid.

The flaps 10.1 and 10.3 are identical and rectangular. They are of width equal to the length L of the panels 1 and 3. The flaps 10.2 and 10.4 are identical to each other. They are of length equal to the length 1 of the panels 2 and 4.

FIG. 2 shows the pack C with the pyramid open so as to show the relative positions of the panels 12.1 to 12.4, of the flaps 14.1 to 14.4, and of the tongues 16. However, as explained below, the disposition of FIG. 2 does not occur in the manufacturing process described below, since the pack is automatically closed at its pyramid end.

FIG. 4 is a vertical section showing an application of the pack C to packaging bottles B which are separated by a crisscross separator S. It can be seen that because of the pyramid portion py of the pack C, corresponding to panels 12.1 to 12.4, the top portions of the bottles B are followed closely by the pack C. The projecting empty corners 18 (in dashed lines) are omitted and replaced by sloping walls that are not very vulnerable to external attack. In addition, compared with a conventional rectangular pack, less sheet material is used in each corner and the saving in each top corner may be as much as about 30%.

FIGS. 8 to 16 are diagrams showing a machine for making the pack C with its pyramid portion py being closed by the flaps 14.1 to 14.4 while its bottom (constituted by the flaps 10.1 to 10.4) is open. For reasons of clarity, these figures are deliberately fragmentary and simplified, with each of them including only those items that are necessary for understanding the manufacturing stages that they illustrate.

Figure 7A:
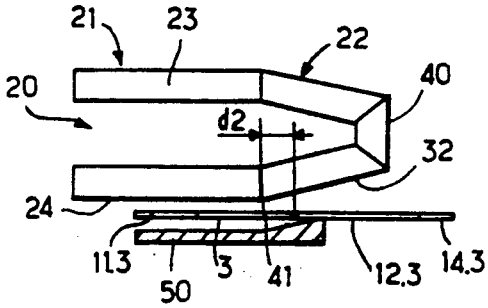
Figure 6B:
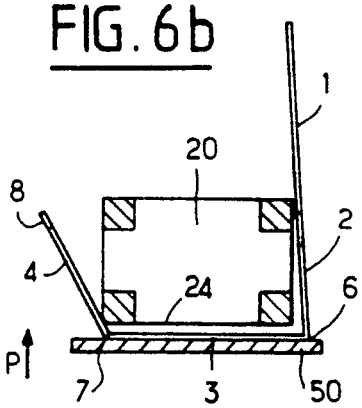
Figure 7B:
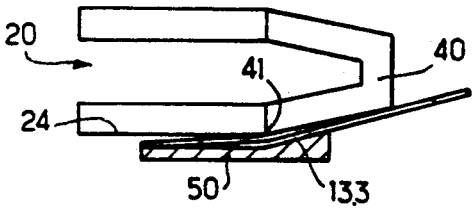
Figure 6C:
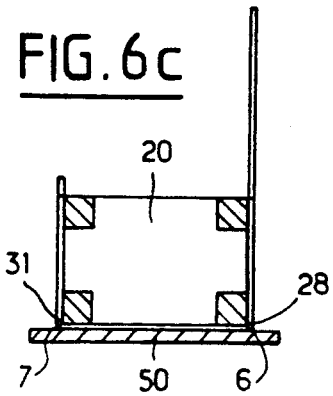
Figure 7C:
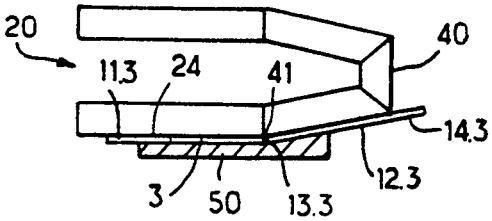
Figure 9:
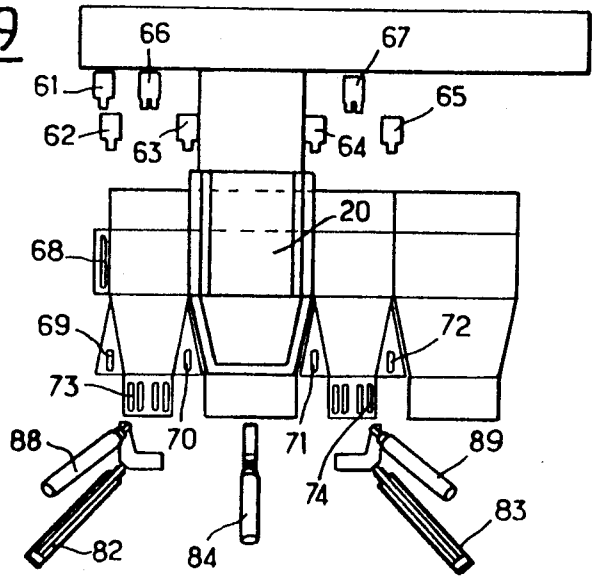
FIGS. 9, 12, and 15 are diagrammatic plan views corresponding respectively to FIGS. 8, 11, and 14.
Figure 10:
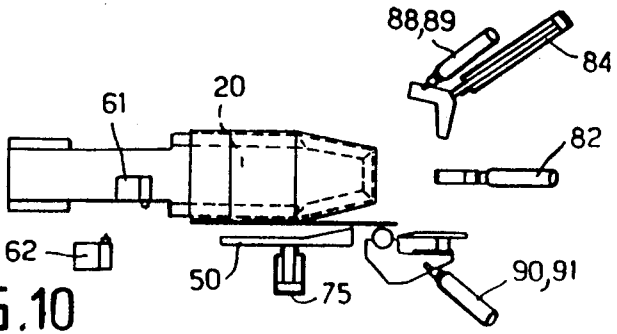
FIGS. 10, 13, and 16 are fragmentary side views perpendicular to FIGS. 8, 11, and 14 and corresponding respectively to FIGS. 9, 12, and 15.
Figure 8:
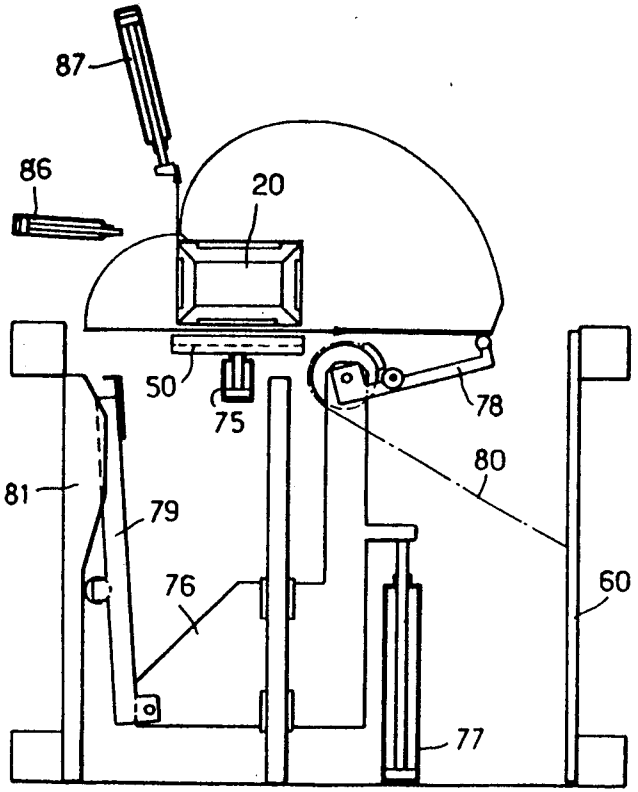
FIGS. 8, 11, and 14 are diagrammatic elevation views of a machine for making the pack of the invention from the blank of FIG. 1, the machine being shown in different stages of pack manufacture.
Figure 12:
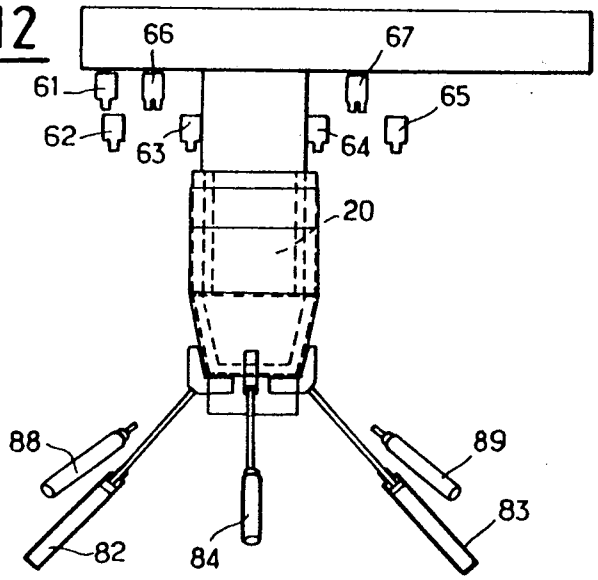
Figure 13:
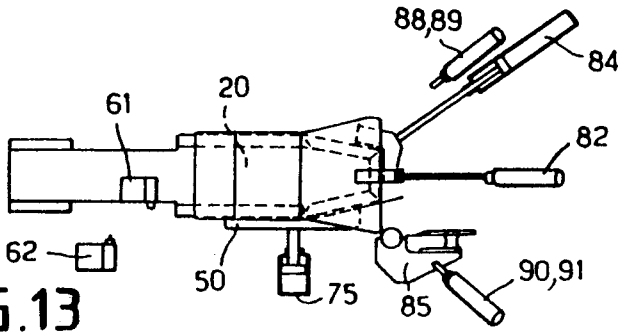
Figure 11:
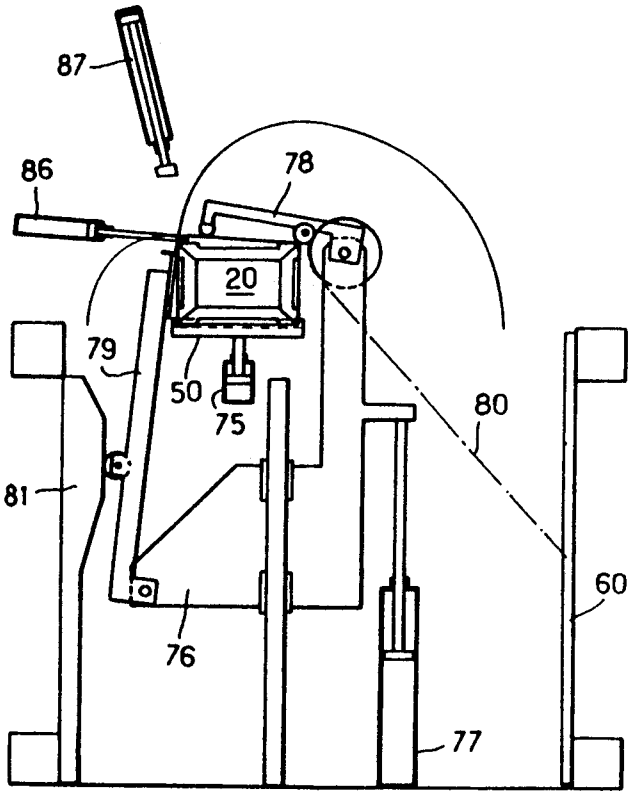

The machine shown in FIGS. 8 to 16 comprises a mandrel 20 (shown on a larger scale in FIG. 5) whose outside shape corresponds to the inside shape of the pack C to be obtained from the blank F. To this end, the mandrel 20 has a portion 21 in the form of a rectangular parallelepiped which is extended by a portion 22 in the form of a pyramid. As shown in FIGS. 8 to 16, the length of the parallelepiped portion 21 of the mandrel 20 may be different from the height h of the side panels of the pack C. The mandrel 20 may be solid or it may be constituted solely by a frame that embodies its corner ridges, as shown in FIGS. 6 and 7. In these figures it is assumed that the mandrel 20 is made up from bars 23 (shown in section in FIGS. 6*a* to 6*c* and in side view in FIGS. 7*a* to 7*c*) defining rectangular lateral thrust faces 24 to 27 for the panels 1 to 4 of the blank F, folding ridges 28 to 31 corresponding to the fold lines 5 to 9, trapezium-shaped thrust faces 32 to 35 for the panels 12.1 to 12.4, joining ridges 36 to 39 therebetween, and an end thrust face 40 for the flaps 14.1 to 14.4. The outline of said end thrust face 40 provides folding ridges corresponding to the fold lines 15.1 to 15.4 of said flaps 14.1 to 14.4.

FIGS. 6*a*, 6*b*, 6*c*, and 7*a*, 7*b*, 7*c* are diagrams showing the process of positioning the blank F relative to the mandrel 20 when it is desired to apply the intermediate panel 3 against the corresponding bottom face 24 of the mandrel 20.

Conventional means, e.g. those shown in Document FR-A-2 629 012, are used to bring the blank F close to the mandrel 20 so that its panel 3 is placed at least approximately facing thrust face 24. Although the lateral positioning and the longitudinal positioning of said panel 3 relative to said face 24 should be as accurate as possible, it may happen that there is a lateral offset d1 and a longitudinal offset d2 between the panel 3 and the thrust faces 24 and 32 (see FIGS. 6*a* and 7*a*). To avoid making folds in the wrong parts of the blank F, i.e. not on the fold lines 6, 7, and 13.3, when the other panels of the blank F are folded relative to the panel 3, arrangements are made for the panel 3 to be at a distance from the thrust face 24 prior to folding said other panels (see FIGS. 6*a* and 7*a*). Thereafter, while said panels 2, 1 and the panel 4 with the tongue 8 are being folded, the panel 3 is moved towards the thrust face 24 by a pressure plate 50 (see FIG. 5) whose profile is concave and which has a face 51 that extends longitudinally relative to the mandrel 20 and is superposable against the rectangular face 24 of said mandrel, and a face 52 which is superposable on the trapezium-shaped face 32 of the mandrel 20, with the faces 51 and 52 being connected to each other via an edge 53 which is superposable on the ridge 41 interconnecting said faces 24 and 32 of said mandrel 20. Thus, as the panel 3 is moved towards the face 24 (arrow f), the panels 2, 1 on one side and the panel 4 together with the tongue 8 on the other side bear against the mandrel 20 (see FIG. 6*b*), thereby providing a lateral guidance effect and positioning the panel 3 laterally exactly relative to the thrust face 24 (see FIG. 6*c*). Simultaneously, the trapezium-shaped faces 32 and 52 exert pressure on the panel 12.3 folding it about fold line 13.3 which connects it to the panel 3 and causing the blank F to slide longitudinally so that said fold line coincides with the ridge 41 (see FIG. 7*b*). When the plate 50 presses the panel 3 against thrust face 24 (see FIGS. 6*c* and 7*c*), the fold lines 6, 7 and 13.3 are exactly superposed over the ridges 28, 31, and 41 respectively of the mandrel 20.

Then, while the blank F is temporarily secured to the mandrel 20 by the pressure exerted by the plate 50, the forming of the pack C can be continued by winding the panels 1, 2, and 4 and the tongue 8 around the rectangular portion 21 of said mandrel and by folding the panels 12.1, 12.2, and 12.4 against the trapezium-shaped faces of the pyramid-shaped portion 22 thereof.

Such winding and such folding causes the panels 1, 2, 4, 12.1, 12.2, and 12.4 to be pressed respectively against the faces 26, 25, 27, 34, 33, and 35, with the tongue 8 being folded over the face 26 (either before or after the flap 1). It is thus possible, e.g. by gluing, to secure the tongue 8 to the flap 1 and to secure the panels 12.1 to 12.4 to one another by means of the triangular tongues 16.

Thereafter, the flaps 14.1 to 14.4 are folded down around the ridges of the end face 40 of the mandrel 20 corresponding to respective fold lines 15.1 to 15.4, thereby pressing against said end face 40, and they are then secured to one another, e.g. by gluing. The pack C shown in FIG. 3 is then obtained fitted over the mandrel 20 and open at its flaps 10.1 to 10.4.

To fill the pack C, it is removed from the mandrel 20 and it is filled through its open bottom constituted by its integral flaps 10.1 to 10.4. After the pack C has been filled, it may be closed by folding down said flaps 10.1 to 10.4 about the respective fold lines 11.1 to 11.4, and finally by securing said flap 10.1 to 10.4 to one another, e.g. by gluing. This results in the closed pack as shown in FIG. 3.

The operations described above can be performed automatically by the machine shown diagrammatically and in part in FIGS. 8 to 16. This machine comprises a frame 60 relative to which the mandrel 20 and the pressure plate 50 are mounted. The machine also includes a device (not shown) of any conventional type suitable for taking the blanks F one by one from a magazine and bringing them under the mandrel 20. Glue dispensers 61 to 67 mounted on the frame 60 serve to deposit lines of adhesive 68 to 74 respectively on the tongue 8, on the tongues 16, and on the flaps 14.2 and 14.4 while the blank F is being brought under the mandrel 20.

Thus, because of the dispensers 61 to 67, the glue-bearing blank F is disposed beneath the mandrel 20 in the position shown in FIGS. 6*a* and 7*a*, above the pressure plate 50 which is driven by an actuator 75 carried by the frame 60.

To wind the panels 1 to 4 and the tongue 8 around the rectangular portion 21 of the mandrel 20, the machine includes a mechanism having moving equipment 76 that can be raised or lowered by means of an actuator 77 connected to the frame 60.

The moving equipment 76 has two hinged arms 78 and 79, e.g. respectively driven by a linkage 80 connected to the frame 60 and by a cam 81 mounted on said frame.

Actuators 82 to 84, e.g. piston type actuators, are mounted on the frame 60 and serve respectively to fold the panels 12.4, 12.2, and 12.1 and the flaps 14.4, 14.2, and 14.1. Another actuator 85 serves to fold the flap 14.3. Pressers 86 and 87 also mounted on the frame 60 are provided to press the tongue 8 and the panel 1 against the face 26 of the mandrel 20. Other pressers 88 to 91 (also mounted on the frame 60) are provided to fold the tongues 16 against the mandrel 20.

With the blank F brought beneath the mandrel 20 so as to occupy the position shown in FIGS. 6*a* and 7*a* (see FIGS. 8 and 9), the actuators 75 and 77 are actuated firstly to move the pressure plate 50 towards the mandrel 20 and secondly to cause the hinged arms 78 and 79 to respond to the upwards movement of the moving equipment 76 to fold the panels 1, 2, and 4 of the blank F disposed on opposite sides of the panel 3. The blank F then successively takes up the positions relative to the mandrel 20 that are shown in FIGS. 6*a*, 6*b*, 6*c* and 7*a*, 7*b*, 7*c*. Thereafter, as the moving equipment 76 continues to move upwards, the arms 78 and 79 press the panels 1, 2, and 4 respectively against the corresponding faces of the mandrel 20 (see FIG. 11).

Figure 14:
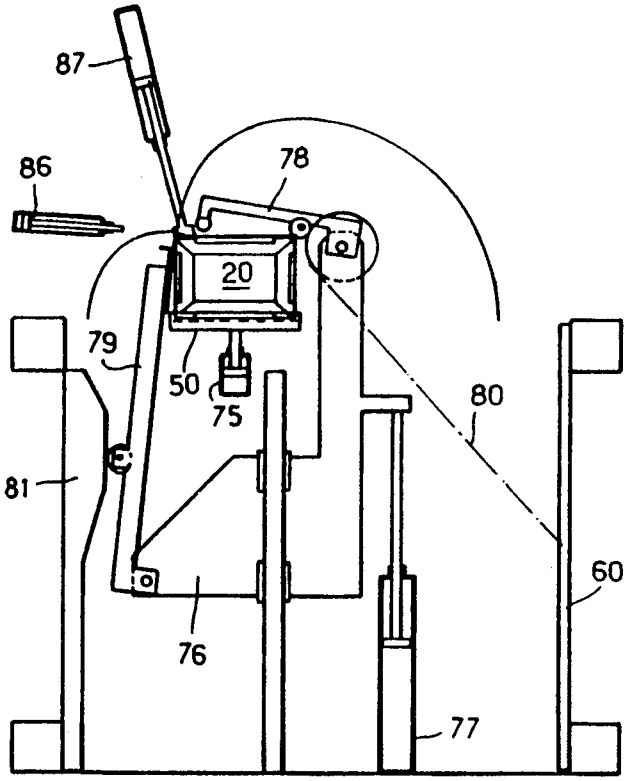

The actuators 82 to 84 fold the panels 12.2, 12.1, and 12.4 and the flaps 14.2, 14.1, and 14.4 (FIGS. 12 and 13), the presser 86 presses the tongue 8 against the face 26 of the mandrel (FIG. 11), after which the other presser 87 presses the panel 1 against the tongue 8 and the face 26 (FIG. 14). Because of the lines of adhesive 68, 73, and 74, the panel 1 is thus secured to the tongue 8 and the flaps 14.1, 14.2, and 14.4 are secured to one another (see FIGS. 12 and 13).

Figure 15:
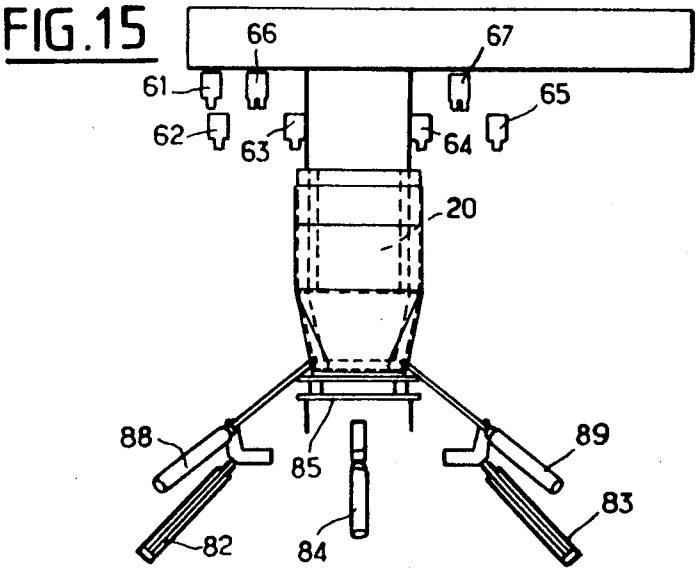
Figure 16:
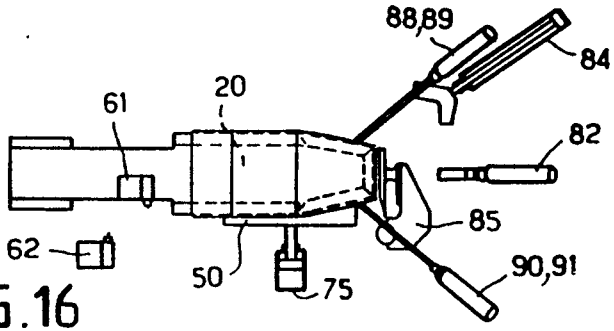

Thereafter, the actuators 85 and 88 to 91 fold the flap 14.3, and the tongues 16 respectively against the end face 40 and the faces 32 and 34 of the mandrel 20 (FIGS. 15 and 16). Because of the lines of adhesive 69 to 72, 73 and 74, the tongues 16 are secured to the panels 12.1 and 12.3, and the flap 14.3 is secured to the flaps 14.1, 14.2, and 14.4.

Figure 17:
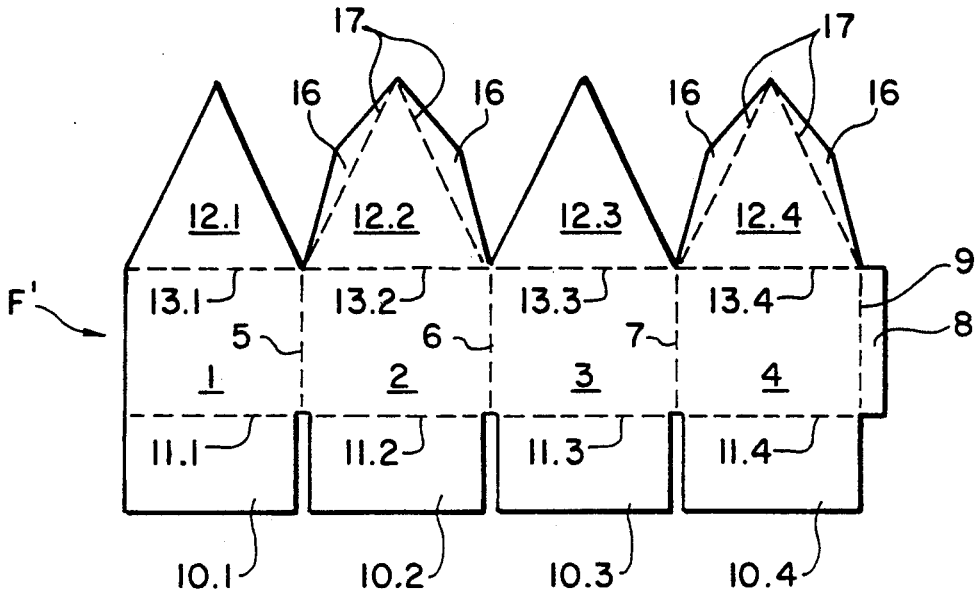
FIG. 17 shows a flat blank of sheet material for making another embodiment of a pack in accordance with the present invention.

The blank F' of sheet material (e.g., card or corrugated card) shown in FIG. 17 comprises a sequence of four square panels 1 to 4 in alignment and connected together in pairs via parallel preformed fold lines 5 to 7. A tongue 8 is disposed along the free edge of end panel 4 of said sequence of panels and is connected to said end panel 4 by a fold line 9 which is parallel to the fold lines 5 to 7. One side of each of the panels 1, 2, 3, and 4 is provided with a respective rectangular flap 10.1, 10.2, 10.3, and 10.4. Each rectangular flap 10.1, 10.2, 10.3, and 10.4 is hinged to the corresponding panel by a preformed fold line 11.1, 11.2, 11.3, or 11.4. These fold lines 11.1, 11.2, 11.3, and 11.4 are in alignment and perpendicular to the fold lines 5 to 7 and 9. The sides of the panels 1 to 4 opposite to their sides associated with the flaps 10.1 to 10.4 are associated with respective triangular-shaped panels 12.1, 12.2, 12.3, and 12.4. Each panel 12.1, 12.2, 12.3, and 12.4 is hinged to the corresponding panel via a preformed fold line, 13.1, 13.2, 13.3, and 13.4 corresponding to the base thereof. The fold lines 13.1, 13.2, 13.3, and 13.4 are in alignment and perpendicular to the fold lines 5 to 7 and 9. The square panels 1 to 4 and the tongue 8 are all of the same height h and the same length l. The two panels 2 and 4 are identical to each other, and are of length l, which is less than L. Finally, respective triangular tongues 16 are hinged along the two sloping edges of each of the panels 12.2 and 12.4 via preformed fold lines 17. The triangular tongues 16 of the panel 12.2 extend between said panel and the panels 12.1 and 12.3, while one of the triangular tongues 16 of the panel 12.4 extends between said panels and the panel 12.3. The other triangular tongue 16 of the panel 12.4 projects outwards on the same side as the tongue 8. The blank F' is designed to form an invention pack—reference is made to FIG. 1.

Figure 18:
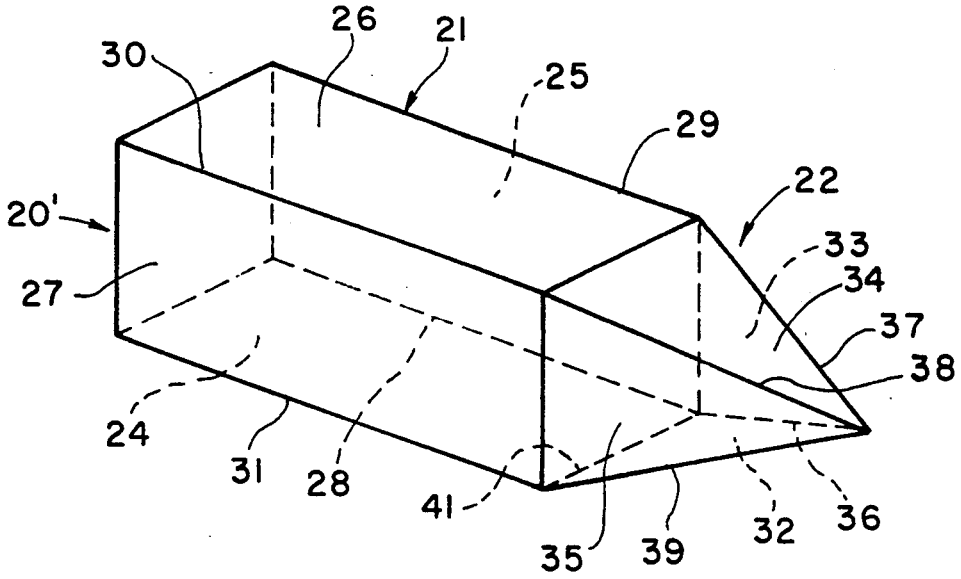
FIG. 18 is a perspective view of a mandrel for making the pack of the invention embodiment using the blank of FIG. 17.

Mandrel 20', in FIG. 18, has an outside shape which corresponds to the inside shape of the pack to be obtained from the blank F'. To this end, the mandrel 20' has a portion 21 in the form of a square parallel-epiped which is extended by a portion 22 in the form of a pyramid. The mandrel 20' may be solid or it may be constituted solely by a frame that embodies its corner ridges. Portion 21 of the mandrel 20' in FIG. 6*a* to 6*c* and in side view in FIGS. 7*a* to 7*c* has lateral thrust faces 24 to 27 for the panels 1 to 4 of the blank F, folding ridges 28 to 31 corresponding to the fold lines 5 to 9, and triangle-shaped thrust faces 32 to 35 for the panels 12.1 to 12.4, joining ridges 36 to 39 therebetween.

We claim:

1. A machine for making a pack from a blank of sheet material comprising a sequence of rectangular first panels connected to one another via mutually parallel first fold lines and a first set of end flaps disposed on one side of said sequence of panels and connected thereto via second fold lines perpendicular to said first fold lines and intended to form at least a portion of the bottom of said pack, said machine including:

a mandrel whose outside section corresponds to the inside section of said pack to be obtained;

means for freely supporting an intermediate panel of said sequence of panels at least approximately facing the corresponding face of said mandrel, but at a distance therefrom, and then for moving said intermediate panel towards said corresponding face of the mandrel, and then pressing said intermediate panel against said corresponding face after folding the panels adjacent to said intermediate panel so that said adjacent panels bear against said mandrel;

means for winding said sequence of first panels around said mandrel; and means for fixing together the end panels of said sequence of first panels when wound around said mandrel in this manner;

wherein said blank includes trapezium-shaped or triangular second panels each of which is connected via its base to the side of a corresponding one of said first panels that is furthest from the end flaps of said first set, along a third fold line perpendicular to said first fold lines, with the sloping lateral edges of said second panels being free:

said mandrel being in the form of a rectangular parallelepiped having the base of a truncated pyramid or pyramid placed thereagainst;

said means for supporting, for moving, and for pressing said intermediate panel including a pressure plate having two rigidly interconnected faces, a first one of said faces corresponding to said intermediate panel and a second one of said faces corresponding to that one of said second panels which is adjacent to said intermediate panel, said first and second faces of the pressure plate defining a dihedral angle such that when said first face is pressed against the corresponding face of the rectangular portion of the mandrel, said second face is pressed against one of the faces of the truncated pyramid-shaped or pyramid-shaped portion of said mandrel that corresponds to said adjacent second panel, the edge of said dihedral angle then coinciding with the ridge of said mandrel between said faces of said mandrel that correspond respectively to said rectangular portion and to said truncated pyramid-shaped or pyramid-shaped portion;

means are provided for pressing said second panels against respective corresponding faces of the truncated pyramid-shaped or pyramid-shaped portion of said mandrel; and means are provided for fixing together said second panels when pressed in this way against said mandrel.

2. A machine according to claim 1, for a blank in which at least some of said second panels include a foldable triangular tab along at least one of their free sloping edges, the tabs being connected to the corresponding second panels by respective fold lines, wherein the means for fixing said second panels together include means for folding said triangular tabs and for fixing them to the second panels carrying them.

3. A machine according to claim 1, for a blank in which said second panels are trapezium-shaped and which includes a second set of end flaps disposed adjacent to the small bases of said second panels and connected thereto by fourth fold lines perpendicular to said first fold lines, for the purpose of forming at least a portion of a closure face for said pack, wherein the machine includes:

means for folding the flaps of said second set against the end face of the pyramid-shaped portion of said mandrel; and means for fixing together said flaps folded down in this way.

4. A machine according to claim 1, wherein said means for winding said sequence of first panels around the mandrel comprise moving equipment including rocking arms.

* * * * *